US007280115B2

(12) United States Patent
Wang et al.

(10) Patent No.: US 7,280,115 B2
(45) Date of Patent: Oct. 9, 2007

(54) IMAGE SIGNAL PROCESSING METHOD AND DEVICE

(75) Inventors: Chi-Feng Wang, Jhonghe (TW); Szu-Ping Chen, Kaohsiung (TW); Jui-Yuan Tsai, Tainan (TW); Jin-Sheng Gong, Longtan Township (TW)

(73) Assignee: Realtek Semiconductor Corp., HsinChu (TW)

( * ) Notice: Subject to any disclaimer, the term of this patent is extended or adjusted under 35 U.S.C. 154(b) by 576 days.

(21) Appl. No.: 10/771,031

(22) Filed: Feb. 3, 2004

(65) Prior Publication Data

US 2004/0207585 A1 Oct. 21, 2004

(30) Foreign Application Priority Data

Apr. 17, 2003 (TW) ..... 92108991 A

(51) Int. Cl.
*G09G 5/02* (2006.01)

(52) U.S. Cl. ..... 345/589; 345/96

(58) Field of Classification Search ..... 345/87–100, 345/589, 600, 605; 348/537, 572; 341/155, 341/161

See application file for complete search history.

(56) References Cited

U.S. PATENT DOCUMENTS 5,964,708 A * 10/1999 Freeman et al. ..... 600/447
6,014,258 A * 1/2000 Naka et al. ..... 359/618
6,414,611 B1 7/2002 Nagaraj
6,545,626 B1 4/2003 Nakada
2003/0034984 A1 * 2/2003 Murata ..... 345/589

FOREIGN PATENT DOCUMENTS

TW 475333 2/2002

OTHER PUBLICATIONS

U.S. Appl. No. 09/419,616, filed Oct. 14, 1999.

* cited by examiner

*Primary Examiner*—Richard Hjerpe
*Assistant Examiner*—Jean Lesperance
(74) *Attorney, Agent, or Firm*—Winston Hsu

(57) ABSTRACT

An image signal processing method adapted to an AFE device, which respectively generates first and second colors of digital signals according to first and second colors of analog signals. First, the first color of odd and even signals and the second color of odd and even signals are generated according to the first and second colors of analog signals, respectively. In a single channel mode, the first color of odd or even signal serves as the first color of digital signal for output, and the second color of odd or even signal serves as the second color of digital signal for output. In a dual channel mode, the first color of odd signal and second color of even signal are synchronously outputted, and the first color of even signal and second color of odd signal are also synchronously outputted. The first color of odd and even signals are combined to form the first color of digital signal, and the second color of odd and even signals are combined to form the second color of digital signal.

18 Claims, 5 Drawing Sheets

IMAGE SIGNAL PROCESSING METHOD AND DEVICE

This application claims the benefit of Taiwan application Serial No. 92108991, filed Apr. 17, 2003.

BACKGROUND OF THE INVENTION

1. Field of the Invention

The invention relates to an image signal processing method and device, and more particularly to an image signal processing method and device for a LCD (liquid crystal display) monitor.

2. Description of the Related Art

The cathode ray tube (CRT) display technology is always the mainstream of display for a long time, and its associated technology is well developed after several tens of years of improvements. Recently, the display technology has been greatly modified owing to the trend of digitalization. Thus, the digital display tends to replace the CRT monitor.

Unlike the operation method of the conventional analog display, the digital signals of the digital display replace the electron beams of the CRT monitor. So, the digital display may be made thinner and lighter, and makes it possible to get rid of the problems of radiation and frame flickers. The liquid crystal display (LCD) and the plasma display panel (PDP) is representative of the mainstreams of the present digital display technology. At present, because the LCD technology is suitable for the small-scale display and the domestic televisions are mainly the CRT monitors, the application field of the LCD technology in the market is wider than that of the PDP technology.

In the applications of the personal computers, because the display cards (VGA cards) of many computer systems can only output analog image signals, the LCD has to convert the analog signals into digital signals for display. Therefore, the image processing device of the LCD must have an analog front end (AFE) device and a scalar for performing operations of signal conversion and scaling, wherein the AFE device is for converting analog image signals into digital image signals, while the scalar is for computing the digital image signals so as to obtain images with various resolutions.

The function of the AFE device is to convert analog image signals, which are composed of three primary colors of red (R), green (G), and blue (B), into digital image signals. A typical AFE device has three sets of ADCs (analog-to-digital converters) 110, 130 and 150 for converting red analog signals RA, green analog signals GA and blue analog signals BA into red digital signals RD, green digital signals GD and blue digital signals BD, respectively, as shown in FIG. 1. In the AFE device, the most important portion is the high-speed ADC, the performance of which directly influences the frame quality of the LCD monitor. Taking a 15" LCD monitor as an example, if the display mode is 1024×768×85 Hz (XGA mode), the ADC has to work at 94.500 MHz. That is, the clock generator 170 has to output clock signals CLK with 94.500 MHz to the ADCs 110, 130 and 150. With the development of the LCD technology, there will be more and more large-scale panels to be commercialized. If a 17" LCD monitor is operating under the SXGA mode (1280×1024×85 Hz), the working clock of the ADC may reach 157.500 MHz. Consequently, an ADC with high-speed and medium resolution plays an important role in the AFE device. With the increasing of the integration degree of the chip, the current trend is to integrate the AFE device, the scalar and other peripheral circuits on the same chip, which is called as a LCD control chip.

The required clock of the ADC will get higher and higher as the resolution of the liquid crystal panel gets higher and higher. However, owing to the support limitation of the manufacturing process, it is difficult to implement the ADC having a working clock higher than a certain extreme value. In order to overcome such a problem, the interleaved circuit architecture having increased speed but large area is adopted during the design phase. In such methods, an ADC working at the frequency f may be equivalent to an odd converter and an even converter both working at the frequency f/2, and the analog signals are converted into an odd signal and an even signal. Thereafter, a selector (e.g., a multiplexer) working at the frequency f is adopted to alternatively output the odd signal and the even signal, both of which may be combined into the desired digital signal. FIG. 2 is a schematic illustration showing an interleaved ADC. Taking the conversion of the red analog signal RA as an example, the odd converter 211 and the even converter 213 of the ADC 210 operate, according to the clock signal HCLK, to convert the red analog signal RA into a red odd signal RDO and a red even signal RDE, respectively. Thus, the frequency of each of the red odd signal RDO and the red even signal RDE is the same as that of the clock signal HCLK. The multiplexer 220 alternatively switches between the odd converter 211 and the even converter 213 according to the clock signal CLK, and the red odd signal RDO and the red even signal RDE may be combined into the red digital signal RD for output accordingly. The frequency of the clock signal CLK is twice that of the clock signal HCLK and may be implemented by the frequency divider 270. Similarly, the odd converter 231 and the even converter 233 of the ADC 230 may convert the green analog signal GA into the green odd signal GDO and the green even signal GDE, both of which are then combined into the green digital signal GD by the multiplexer 240. The odd converter 251 and the even converter 253 of the ADC 250 may convert the blue analog signal BA into the blue odd signal BDO and the blue even signal BDE, both of which are then combined into the blue digital signal BD by the multiplexer 260.

Simply speaking, in the interleaved architecture, the analog signals of the three primary colors may be converted into the digital signals with the frequency f if each ADC works at the frequency f/2. Consequently, the circuit design difficulty may be greatly reduced, but a larger circuit area is required.

FIG. 3 shows timing charts of the clock signals CLK and HCLK, the red odd signal RDO, the red even signal RDE and the red digital signal RD, wherein the frequency of the clock signal CLK is one half that of the clock signal HCLK. As mentioned above, the frequency of each of the red odd signal RDO and the red even signal RDE is the same as that of the clock signal HCLK. The multiplexer alternatively switches between the odd converter and the even converter according to the clock signal CLK so as to combine the red odd signal RDO and the red even signal RDE into the red digital signal RD, wherein the frequency of the red digital signal RD is the same as that of the clock signal CLK. Similarly, the methods for forming the green and blue digital signals are also the same as that for forming the red digital signal, and detailed descriptions thereof will be omitted.

In the high-frequency mode, digital signals of the three primary colors are combined by the odd and even signals generated from the odd and even converters, respectively. Therefore, if the odd and even converters have unsymmetrical circuit architectures caused by the differences of manufacturing processes or other reasons, fine ripples with different brightness will be caused in the gray-scale frame. FIG. 4 is a schematic illustration showing the actual gray-scale distribution of the digital signal. It is assumed that the odd symbols denote the pixels (e.g., pixels P1, P3, P5, . . . P11 ) for the odd signals outputted from the odd converters, and the even symbols denote the pixels (e.g., pixels P2, P4, P6, . . . P12) for the even signals outputted from the even converters. Theoretically, each pixel value should fall on the horizontal line, as shown in FIG. 4A. However, because the circuit architectures of the odd and even converters are not symmetrical, the pixel value is not the same as the theoretical value. In some cases (e.g., in this embodiment), it is possible that all pixel values corresponding to the odd signals outputted from the odd converters are higher than the theoretical values, and all pixel values corresponding to the even signals outputted from the even converters are lower than the theoretical values (or the odd pixel values are lower and the even pixel values are higher, depending on the circuit designs). Consequently, interleaved fine ripples with different brightness in the gray-scale frame will be produced. Of course, it is inevitably that the odd or even signals are different from the theoretical values. That is, one of the odd or even signals may coincide with the theoretical values). However, in terms of outputting the same pixel value, the odd signal will be indispensably different from the even signal, which is the main reason causing the different brightness.

Of course, such a problem directly influences the image quality. The influence will become more significant in the display mode of lower frequency or the frame with the simpler background, and will be found by the user. Hence, it is necessary to find and solve the source of the problem in order to improve the display effect of the monitor and to enhance the display quality.

SUMMARY OF THE INVENTION

It is therefore an object of the invention to provide an image signal processing method and device capable of eliminating the phenomenon of fine ripples with different brightness.

The invention achieves the above-identified object by providing an image signal processing method and device adapted to an AFE device, which respectively generates a first color of digital signal and a second color of digital signal according to a first color of analog signal and a second color of analog signal. The method includes the following steps.

First, the first color of odd signal and the first color of even signal are generated according to the first color of analog signal, and the second color of odd signal and the second color of even signal are generated according to the second color of analog signal. In a single channel mode, the first color of odd signal or first color of even signal serves as the first color of digital signal for output, and the second color of odd signal or second color of even signal serves as the second color of digital signal for output. In a dual channel mode, the first color of odd signal and second color of even signal are synchronously outputted, and the first color of even signal and second color of odd signal are also synchronously outputted. The first color of odd signal and the first color of even signal are combined to form the first color of digital signal, and the second color of odd signal and the second color of even signal are combined to form the second color of digital signal.

Other objects, features, and advantages of the invention will become apparent from the following detailed description of the preferred but non-limiting embodiments. The following description is made with reference to the accompanying drawings.

DETAILED DESCRIPTION OF THE INVENTION

After the reason of distortion is found, the solutions for the problems in the low-frequency display mode and the high-frequency display mode will be proposed.

Figure 1:
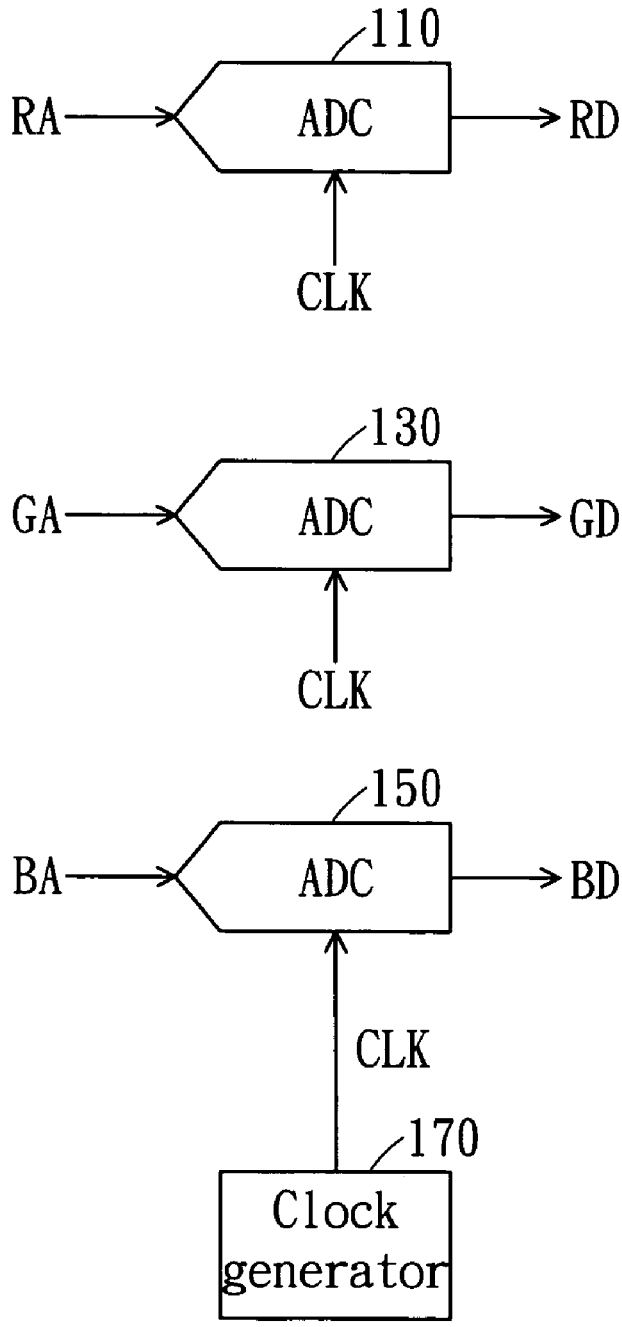
FIG. 1(PRIOR ART)
FIG. 1 is a schematic illustration showing a conventional ADC.
Figure 2:
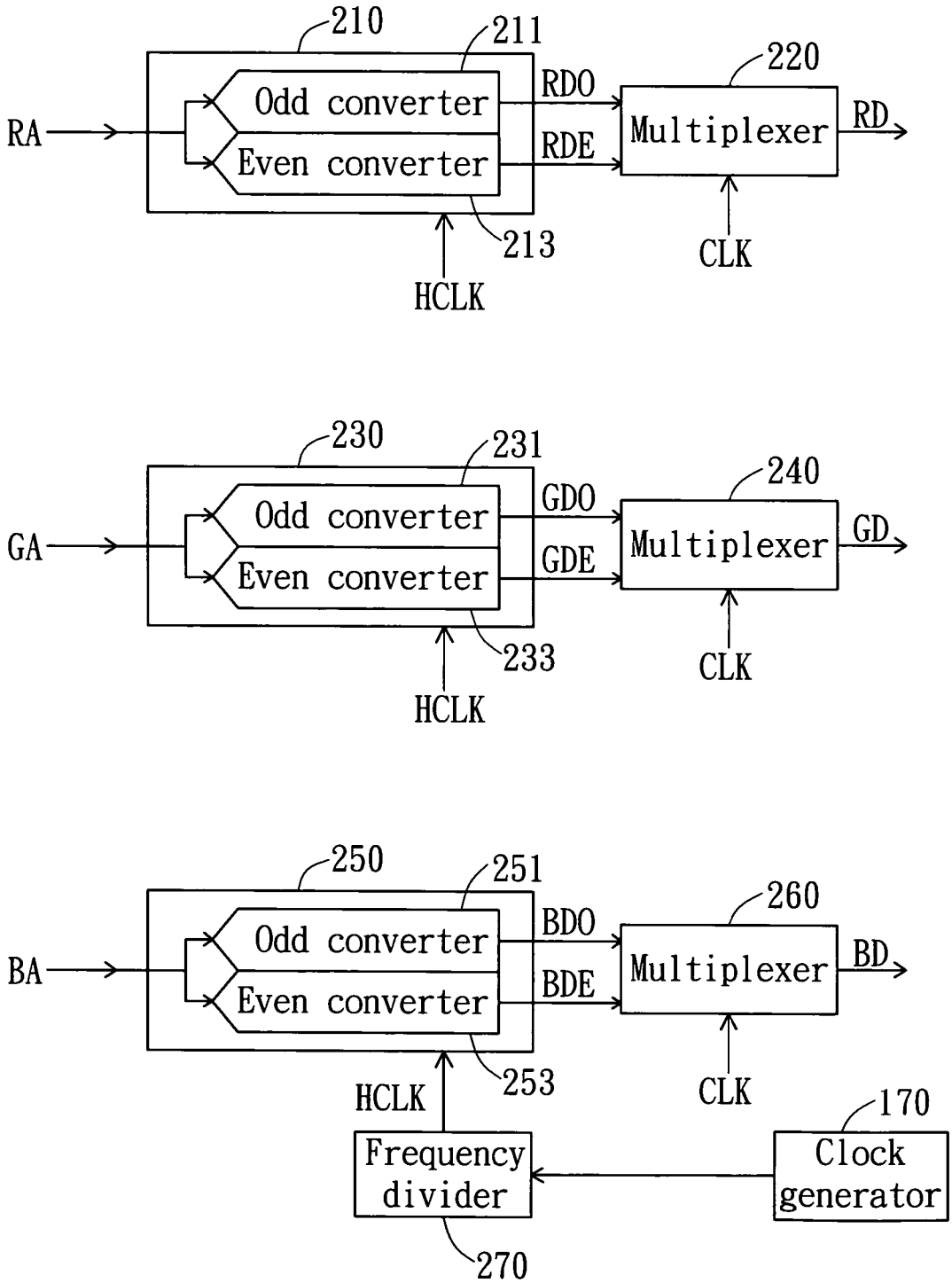
FIG. 2(PRIOR ART)
FIG. 2 is a schematic illustration showing a conventional interleaved ADC.
Figure 3:
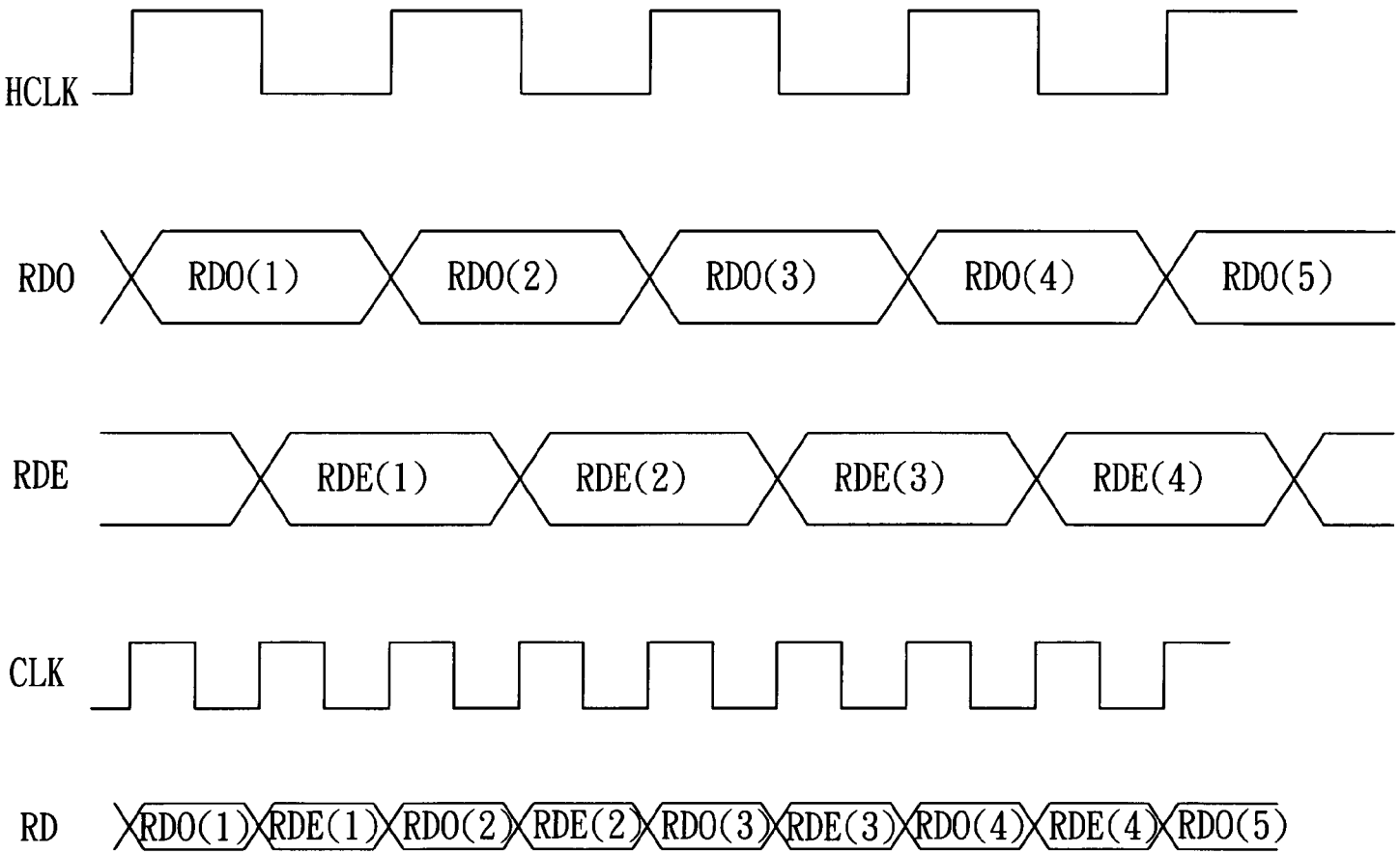
FIG. 3(PRIOR ART)
FIG. 3 shows timing charts of the clock signals, the red odd signal, the red even signal and the red digital signal.
Figure 4:
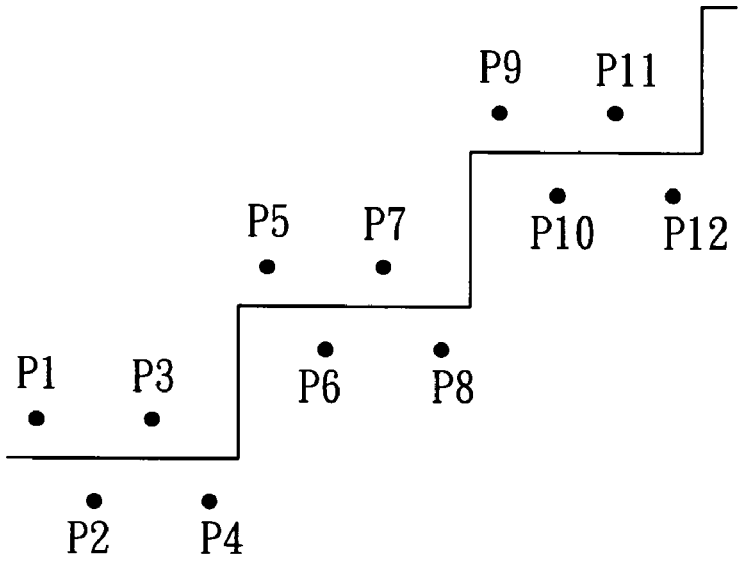
FIG. 4(PRIOR ART)
FIG. 4 is a schematic illustration showing the actual gray-scale distribution of the digital signal.

In the low-frequency mode, the circuit operation speed is high enough, so the circuit may be caused to operate in a single channel mode and to disable one of the odd and even converters and enable the other one of the converters to perform the analog-to-digital conversion process. At this time, three sets (RGB) of odd (or even) duty converters operate at full speed, and its equivalent circuit may be illustrated in FIG. 1. Because only the odd or even converter is selected to operate in this mode, the problem of unsymmetrical odd and even signals cannot occur. That is, the fine ripples with uneven brightness will not occur. It is to be noted that the three sets of ADCs preferably have the same selection for selecting the same odd (or even) converters for data processing such that the red, green, and blue digital signals may have uniform outputs.

Figure 5:
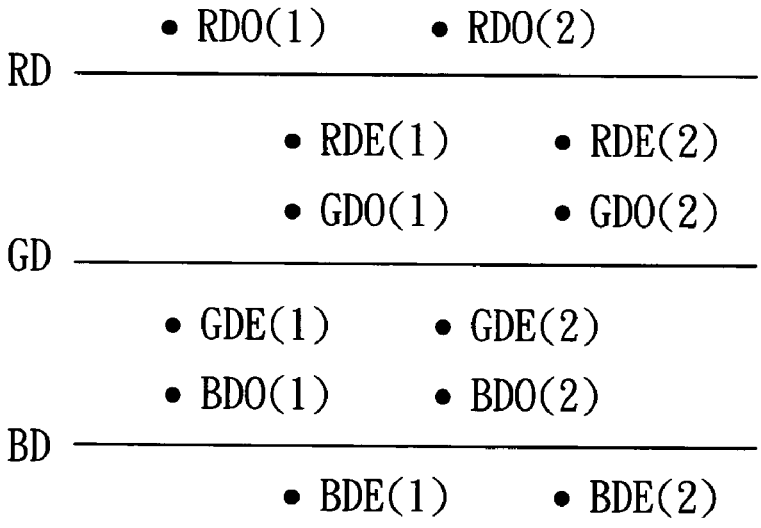
FIG. 5 is a schematic illustration showing an image signal processing method according to a preferred embodiment of the invention.

In the high-frequency mode, because the operation speed of the single converter is not high enough, signals outputted from the odd and even converters have to be alternatively and rapidly combined, and then the mode is the dual channel mode. However, the unsymmetrical problem does exist between the odd and even signals. The invention utilizes a compensation method to reduce the influence level and improve the quality. FIG. 5 is a schematic illustration showing an image signal processing method according to a preferred embodiment of the invention. Each pixel of the LCD monitor is actually composed of red, green and blue sub-pixels, each of which displays its corresponding color according to the odd or even signal. Because the unsymmetries between the odd and even converters of the red, green, and blue ADCs are often the same (i.e., the red, green, and blue odd signals outputted from three odd converters are simultaneously greater than the red, green, and blue even signals outputted from the even converter), the enhancement effects (the dark becomes darker, the brightness becomes brighter) are caused in the visual aspect, and the uneven brightness becomes more and more significant. In order to solve this problem, it is possible to interleave the odd signals with the even signals of the red, green and blue sub-pixels of the same pixel so as to compensate for the errors between the odd and even signals. For example, if the vision is sensitive to the green color, it is possible to make the red and blue sub-pixels output the same kind of signals, and make the green sub-pixel output another kind of signal. In the pixel P1, for example, the red sub-pixel displays according to the red odd signal RDO(1), the green sub-pixel displays according to the green even signal GDE(1), and the blue sub-pixel displays according to the blue odd signal BDO(1). In the pixel P2, the red sub-pixel displays according to the red even signal RDE(1), the green sub-pixel displays according to the green odd signal GDO(1), and the blue sub-pixel displays according to the blue even signal BDE(1). In the pixel P3, the red sub-pixel displays according to the red odd signal RDO(2), the green sub-pixel displays according to the green even signal GDE(2), and the blue sub-pixel displays according to the blue odd signal BDO(2). In other words, the AFE device synchronously outputs the red odd signal RDO(1), the green even signal GDE(1) and the blue odd signal BDO(1) at time t (n), synchronously outputs the red even signal RDE(1), the green odd signal GDO(1) and the blue even signal BDE(1) at time t (n+1), and synchronously outputs the red odd signal RDO(2), the green even signal GDE(2) and the blue odd signal BDO(2) at time t (n+2). The LCD monitor displays corresponding frames according to the output signals of the AFE device. Because the three sub-pixels of the same pixel do not display according to the odd or even signals uniformly and completely, it is possible to compensate for most of the differences between the odd and even signals and thus to improve the phenomenon of uneven brightness.

Figure 6:
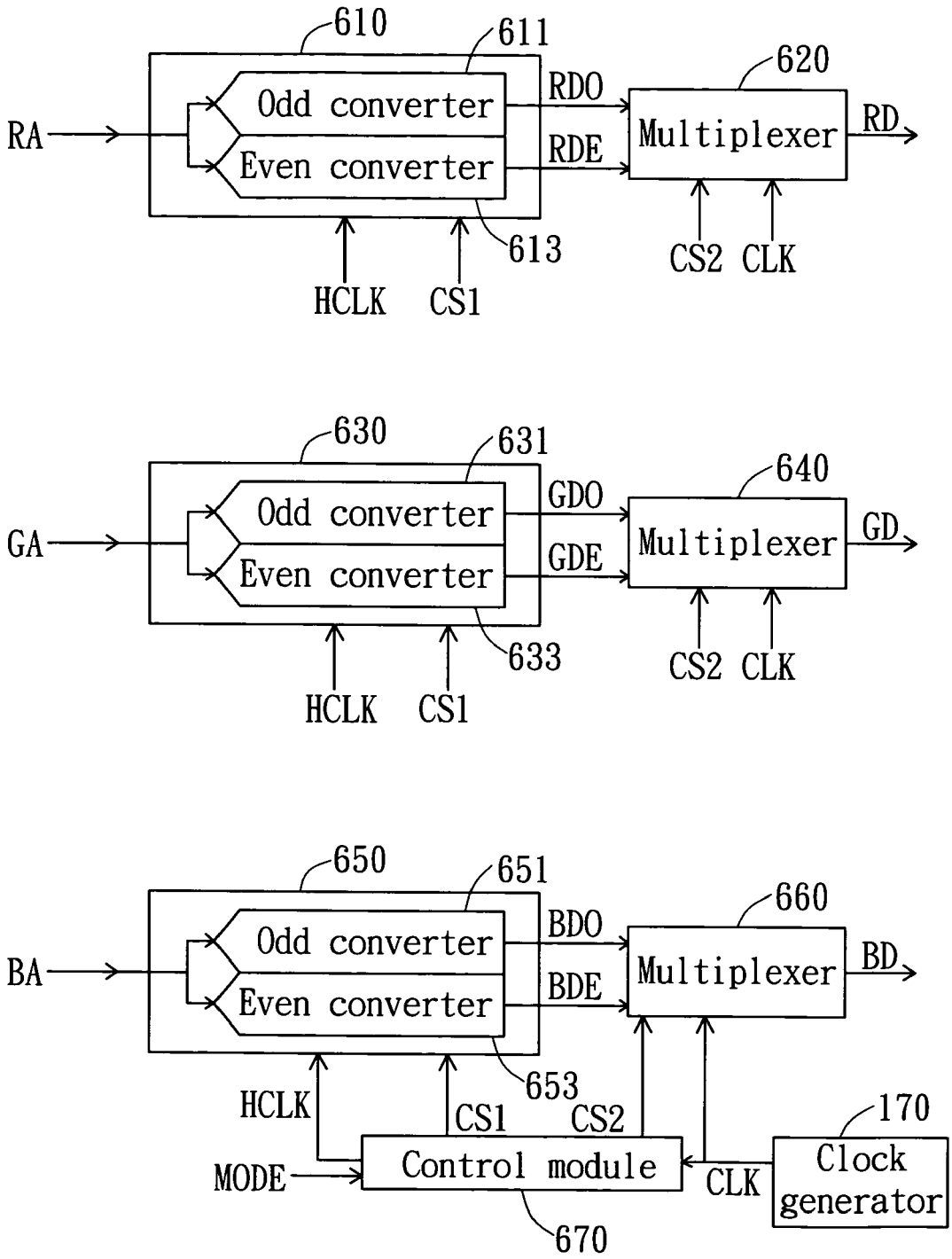
FIG. 6 is a block diagram showing an AFE device according to a preferred embodiment of the invention.

In order to achieve the above-mentioned idea, it is possible to add a control module to the circuit, wherein the control module selects the operation mode (single or dual channel mode) of the ADC according to a mode parameter, and compensates for the red, green, and blue digital signals with respect to one another in order to achieve the object of decreasing the distortion. FIG. 6 is a block diagram showing the AFE device according to a preferred embodiment of the invention. The AFE device includes ADCs 610, 630 and 650 for respectively converting the red analog signal RA, the green analog signal GA, and the blue analog signal BA into digital signals, a multiplexer 620 for alternatively combining the red odd signal RDO with the red even signal RDE to form the red digital signal RD, a multiplexer 640 for alternatively combining the green odd signal GDO with the green even signal GDE to form the green digital signal GD, and a multiplexer 660 for alternatively combining the blue odd signal BDO with the blue even signal BDE. In the low-frequency mode, the mode parameter MODE may be set to 1 and fed to the control module 670. The control module 670 feeds the control signal CS1 to the even converters 613, 633 and 653 to disable them according to the mode parameter MODE, and feeds the control signal CS2 to the multiplexers 620, 640 and 660 so as to extract the red odd signal RDO, the green odd signal GDO and the blue odd signal BDO as the red digital signal RD, the green digital signal GD and the blue digital signal BD, respectively. Because the signal conversion operations in each channel are only performed by the odd converters, the frequency of the clock signal HCLK is the same as that of the clock signal CLK. Of course, it is also possible to disable the odd converters, utilize the even converters 613, 633 and 653 for converting signals, and extract the red even signal RDE, the green even signal GDE and the blue even signal BDE as the red digital signal RD, the green digital signal GD and the blue digital signal BD, respectively, wherein detailed and similar descriptions thereof will be omitted.

In the high-frequency mode, the mode parameter MODE may be set to 0 and fed to the control module 670. The control module 670 may divide the clock signal CLK by 2 to get the clock signal HCLK, which is fed to the ADCs 610, 630 and 650, and the control signal CS1 is utilized to enable the odd converters 611, 631 and 651 and even converters 613, 633 and 653 to operate. On the other hand, the control signal CS2 may control the multiplexers 620, 640 and 660 to synchronously output the red odd signal RDO, the green even signal GDE and the blue odd signal BDO, and to synchronously output the red even signal RDE, the green odd signal GDO and the blue even signal BDE so as to achieve the object of compensating for the odd and even signals with respect to each other.

In addition, this circuit may be implemented by some other methods. For example, the divider circuit by 2 may be disposed in the ADC, the mode parameter MODE may be implemented in the multiplexers 620, 640 and 660. Furthermore, in the dual channel mode, it is also possible to add a delta sigma modulator to the control module 670 or randomly select the odd or even signal for output so that the naked eyes cannot distinguish the difference between the two signals.

The image signal processing method of the embodiment of the invention at least has the following advantages.

1. In the low-frequency mode, the fine ripples with uneven brightness may be completely avoided by outputting digital signals of three primary colors according to the single channel mode.

2. In the high-frequency state, synchronously outputting the odd and even signals may effectively compensate for the error therebetween and reduce the frame distortion.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An image signal processing method adapted to an AFE (analog front end) device, the AFE device respectively generating a first color of digital signal and a second color of digital signal according to a first color of analog signal and a second color of analog signal, wherein the first color of digital signal is composed of a first color of odd signal and a first color of even signal, the second color of digital signal is composed of a second color of odd signal and a second color of even signal, the image signal processing method comprising the steps of:

generating the first color of odd signal and the first color of even signal according to the first color of analog signal;

generating the second color of odd signal and the second color of even signal according to the second color of analog signal;

synchronously outputting the first color of odd signal and the second color of even signal; and synchronously outputting the first color of even signal and the second color of odd signal.

2. The method according to claim 1, wherein the first color of analog signal and the second color of analog signal are selected from two of a group consisting of a red analog signal, a green analog signal and a blue analog signal.

3. An image signal processing method adapted to an AFE (analog front end) device, the AFE device respectively generating a first color of digital signal and a second color of digital signal according to a first color of analog signal and a second color of analog signal, the image signal processing method comprising the steps of:

generating a first color of odd signal and a first color of even signal according to the first color of analog signal;

generating a second color of odd signal and a second color of even signal according to the second color of analog signal;

outputting the first color of digital signal and the second color of digital signal according to a mode parameter, wherein step (a) is executed when the mode parameter is a single channel mode and step (in) is executed when the mode parameter is a dual channel mode;

(a) selecting and outputting one of the first color of odd signal and the first color of even signal as the first color of digital signal, and selecting and outputting one of the second color of odd signal and the second color of even signal as the second color of digital signal; and (m) synchronously outputting the first color of odd signal and the second color of even signal, and synchronously outputting the first color or even signal and the second color of odd signal, wherein the first color of digital signal is composed of the first color of odd signal and the first color of even signal, and the second color of digital signal is composed of the second color of odd signal and the second color of even signal.

4. The method according to claim 3, wherein the first color of analog signal and the second color of analog signal are selected from two of a group consisting of a red analog signal, a green analog signal and a blue analog signal.

5. An AFE (analog front end) device, comprising:

a first ADC (analog-to-digital converter) receiving an analog signal of a first color, comprising:

a first odd converting circuit for converting the analog signal of the first color to a first odd digital signal; and a first even converting circuit for converting the analog signal of the first color to a first even digital signal;

a second ADC receiving an analog signal of a second color, comprising:

a second odd converting circuit for converting the analog signal of the second color to a second odd digital signal; and a second even converting circuit for converting the analog signal of the second color to a second even digital signal;

a third ADC receiving an analog signal of a third color, comprising:

a third odd converting circuit for converting the analog signal of the third color to a third odd digital signal; and a third even converting circuit for converting the analog signal of the third color to a third even digital signal; and a controller for controlling at least one of the first ADC, the second ADC and the third ADC such that the first ADC, the second ADC and the third ADC output one of the first, second and third odd signals and two of the first, second and third even signals substantially at a first time, and output two of the first, second and third odd signals and one of the first, second and third even signals substantially at a second time.

6. The AFE device of claim 5, wherein the first ADC further comprises a first multiplexer for outputting one of the first odd signal and the first even signal, the second ADC further comprises a second multiplexer for outputting one of the second odd signal and the second even signal and the third ADC further comprises a third multiplexer for outputting one of the third odd signal and the third even signal.

7. The AFE device of claim 6, wherein the first, second and third ADCs operate according to a first frequency and the first, second and third multiplexers operate according to a second frequency, in which the first frequency is different from the second frequency.

8. The AFE, device of claim 5, wherein the first color is red, the second color is green and the third color is blue.

9. The AFE device of claim 8, wherein the controller controls at least one of the first ADC, the second ADC and the third ADC such that the first ADC, the second ADC and the third ADC respectively output the first even signal, the second odd signal and the third even signal substantially at the first time, and respectively output the first odd signal, the second even signal and the third odd signal.

10. The AFE device of claim 5, wherein the first, second and third odd converting circuits correspond to an odd circuit architecture and the first, second and third even converting circuits correspond to an even circuit architecture, in which the odd architecture and the even architecture are asymmetrical.

11. The AFE device of claim 10, wherein one of the odd architecture and the even architecture induces a converted digital value different from a theoretical value.

12. An AFE (analog front end) device, comprising:

a first ADC (analog-to-digital converter) receiving an analog signal of a first color and thereby generating a first odd digital signal and a first even digital signal;

a second ADC receiving an analog signal of a second color and thereby generdting a second odd digital signal and a second even digital signal;

a third ADC receiving an analog signal of a third color and thereby generating a third odd digital signal and a third even digital signal; and a controller for controlling at least one of the first ADC, the second ADC and the third ADC such that the first ADC, the second ADC and the third ADC output one of the first, second and third odd signals and two of the first, second and third even signals substantially at a first time, and output two of the first, second and third odd signals and one of the first, second and third even signals substantially at a second time.

13. The AFE device of claim 12, wherein the first ADC further comprises a first multiplexer for outputting one of the first odd signal and the first even signal, the second ADC further comprises a second multiplexer for outputting one of the second odd signal and the second even signal and the third ADC further comprises a third multiplexer for outputting one of the third odd signal and the third even signal.

14. The AFE device of claim 13, wherein the first, second and third ADCs operate according to a first frequency and the first, second and third multiplexers operate according to a second frequency, in which the first frequency is different from the second frequency.

15. The AFE device of claim 12, wherein the first color is red, the second color is green and the third color is blue.

16. The AFE device of claim 15, wherein the controller controls at least one of the first ADC, the second ADC and the third ADC such that the first ADC, the second ADC and the third ADC respectively output the first even signal, the second odd signal and the third even signal substantially at the first time, and respectively output the first odd signal, the second even signal and the third odd signal substantially at the second time.

17. The AFE device of claim 12, wherein the first, second and third odd digital signals correspond to an odd characteristic and the first, second and third even digital signals correspond to an even characteristic, in which the odd characteristic and the even characteristic are different.

18. The AFE device of claim 17, wherein one of the odd characteristic and the even characteristic represents a converted digital value different from a theoretical value.

* * * * *